US005179804A

United States Patent [19]

Young

[11] Patent Number: 5,179,804

[45] Date of Patent: Jan. 19, 1993

[54] SELF DRAINING DOOR SILL ASSEMBLY

[76] Inventor: Robert H. Young, Rt. 3 Box 177, Beaver Dam, Ky. 42320

[21] Appl. No.: 785,983

[22] Filed: Oct. 31, 1991

[51] Int. Cl.[5] ..... E06B 1/70

[52] U.S. Cl. ..... 49/471; 49/468; 49/470

[58] Field of Search ..... 49/468, 471, 469, 470

[56] References Cited

U.S. PATENT DOCUMENTS

| | | | |
|---|---|---|---|
| 2,167,958 | 4/1939 | Oftedal et al. . | |
| 3,351,420 | 12/1974 | Tibbetts | 49/471 |
| 3,900,967 | 8/1975 | Bursk et al. | 49/468 |
| 3,967,412 | 7/1976 | Governale | 49/468 |
| 4,055,917 | 11/1977 | Coller | 49/469 |
| 4,310,991 | 1/1982 | Seely | 49/470 |
| 4,476,653 | 10/1984 | Speer et al. | 49/468 |
| 4,686,793 | 8/1987 | Mills | 49/471 |
| 4,831,779 | 5/1989 | Kehrli | 49/471 |
| 4,945,680 | 8/1990 | Giguere | 49/468 |
| 5,010,690 | 4/1991 | Geoffrey | 49/468 |

*Primary Examiner*—Philip C. Kannan
*Attorney, Agent, or Firm*—Maurice L. Miller, Jr.

[57] ABSTRACT

A self draining door sill assembly for use in the bottom of an exterior door frame of a house or other building is disclosed. The assembly includes an elongated base and a threshold member adjustably attached to the base for cooperating with and engaging a weather strip attached to the underside of a door when the door is closed in the frame to form a primary water seal. The threshold and base define an elongated water chamber therebetween and the threshold defines an upwardly opening storm drain channel formed in and along an upper, interior side surface portion thereof which terminates in a pair of slots located in opposite ends of the threshold, which slots also communicate with the underlying water chamber. A pair of spaced apart weep channels are formed in the base and extend from a floor of the water chamber exteriorally along the through an exterior side of the base, such that rain water which blows or seeps past the primary seal gathers in the drain channel, flows through the slots onto the floor of the water chamber, migrates along the floor to the weep channels, and then flows through the weep channels out of the assembly. A weather cover panel covers an exterior side portion of the base and a compressible resilient gasket is attached to the weather cover and fills a gap between the weather cover and the threshold member.

19 Claims, 2 Drawing Sheets

SELF DRAINING DOOR SILL ASSEMBLY

BACKGROUND OF THE INVENTION

This invention relates generally to a door sill structure of the self draining type adapted for use in the base of an exterior door frame of a house or other building. More specifically, the invention relates to such an assembly which also includes an adjustable threshold having means for gathering rain water that has blown or seeped past a primary weather seal located in the door frame plane and for expelling such water from the assembly.

Broadly speaking, self draining door sill assemblies for use in exterior door frames are known in the prior art. See, for example, U.S. Pat. No. 4,831,779 issued to D. W. Kehrli et al. on May 23, 1989; U.S. Pat. No. 4,686,793 issued to N. J. Mills on Aug. 18, 1987; U.S. Pat. No. 4,310,991 issued to J. R. Seely on Jan. 19, 1982; U.S. Pat. No. 4,055,917 issued to J. Coller on Nov. 1, 1977; U.S. Pat. No. 3,351,420 issued to P. E. Tibbetts on Dec. 3, 1974 and U.S. Pat. No. 2,167,958 issued to P. R. Oftedal et al. on Aug. 1, 1939.

The door sill structures of Kehrli et al., Mills, Seely, Coller and Tibbetts do not include an adjustable threshold member, which is necessary for assuring a close, compression fit between the member and a primary seal weather strip attached to and along the underside of the door. In fact, of these patents, only the patents to Coller and Tibbetts even disclose a door sill assembly for use with a weather strip attached to the underside of a door.

The patent to Oftedal et al. also discloses a door sill assembly which cooperates with a weatherstrip attached to an underside of an entrance door. However, while the reference structure is said to be adjustable, it is adjustable only horizontally to allow proper positioning of an exteriorally facing flange for proper cooperation with an outer screen door as a screen door stop. The reference structure does not employ means for making separate vertical adjustments along the length of the member underlying the entrance door as would be necessary for assuring satisfactory water tight engagement between the member and the weatherstrip uniformly along the bottom edge of the door.

By means of my invention these and other difficulties encountered using door sill construction of the prior art are substantially overcome.

SUMMARY OF THE INVENTION

It is an object of my invention to provide an adjustable, self draining door sill assembly for use in an exterior door frame of a building which includes a threshold member adjustable to cooperate with weatherstripping attached to the underside of a door when closed in the frame, and for gathering and expelling water which has blown or seeped past a primary weather seal located in the door frame plane.

Briefly, in accordance with my invention, there is provided a self draining, adjustable door sill assembly which includes an elongate base adapted for disposition along a lower side of an exterior door frame between a pair of door jambs. An elongate threshold member is also provided which is disposed over and is adjustably connected to the base for cooperating, in close fitting relationship with a lower edge of a door when in a closed position in the frame. The member and base define an elongate water chamber therebetween and the member also defines an upwardly opening storm drain channel in an upper, interior facing side surface portion thereof. Opposite ends of the drain channel terminate in and communicate with a pair of slots located on opposite ends of the member. The slots also communicate with opposite ends of the water chamber. The assembly also includes a weather cover connected to and overlying an exterior side portion of the base, and means is provided, as defined by the base, for draining water from the water chamber exteriorally beyond the door frame and the assembly.

These and other objects, features and advantages of the present will become apparent to those possessing ordinary skill in the art from the following detailed description and attached drawings upon which, by way of example, only a preferred embodiment of my invention is illustrated.

DESCRIPTION OF THE PREFERRED EMBODIMENT

Figure 1:
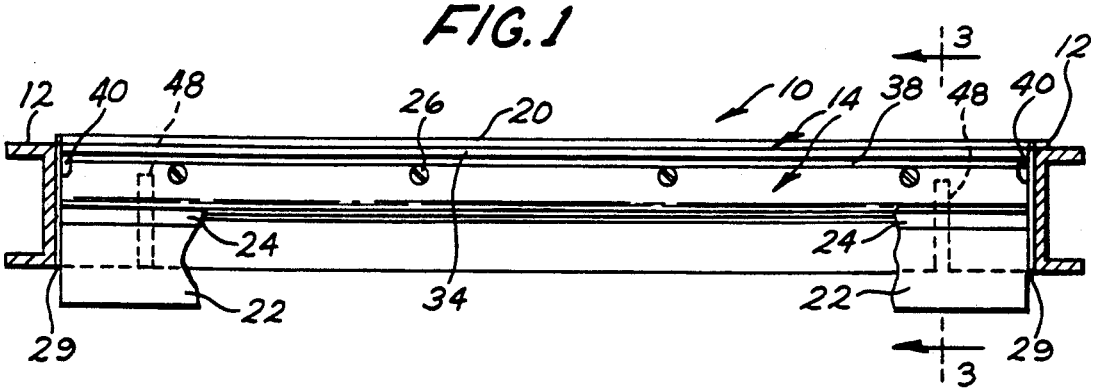
FIG. 1 shows a plan view of an adjustable door sill assembly set between a pair of door jambs with a portion of the assembly torn away for viewing underlying components, thus illustrating a preferred embodiment of my invention.
Figure 3:
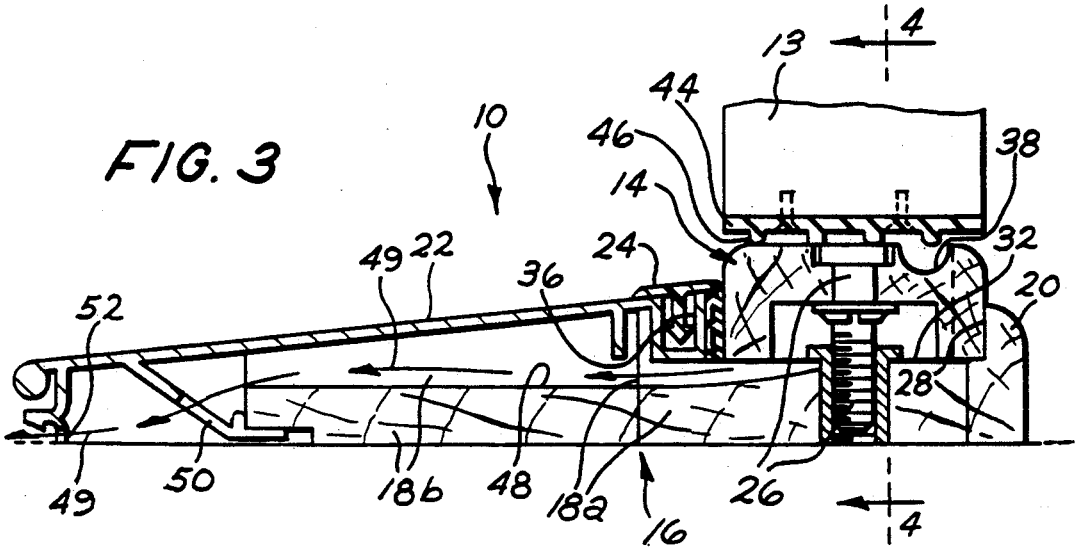
FIG. 3 shows a cross-sectional elevation view of the door sill assembly of FIGS. 1–2 as viewed along cross-section lines 3—3 of FIG. 1 together with an overhanging portion of a door shown in a closed position relative to the assembly.

Referring now to the drawing figures there is shown in a preferred embodiment of my invention, a door sill assembly, generally designated 10, disposed partially in and along the lower side of an exterior or outside door frame of a building between a pair of door jambs 12 (FIG. 1) so as to underlie a door 13 when the latter is in a closed position in the frame as shown in FIG. 3.

Figure 4:
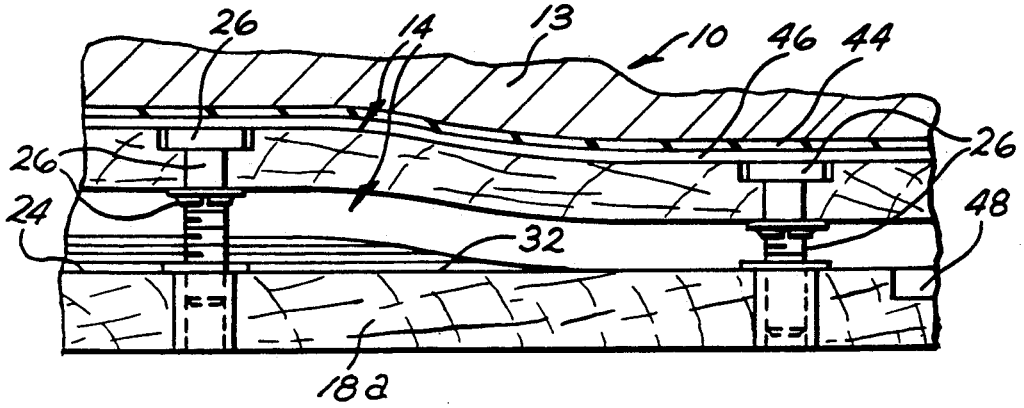
FIG. 4 shows a cross-sectional elevation view of a portion of the door sill assembly of FIGS. 1–3 as viewed along cross-section lines 4—4 of FIG. 3, an adjustable threshold portion of which is shown with exaggerated curvature for illustrative purposes.

The assembly 10 includes an elongated threshold member 14 disposed over and adjustably connected to an elongated base 16, the latter including an interior side base portion **18*a*, an exterior side base portion 18*b* attached to the interior base portion, and an elongated shoe strip 20 attached to and along an interior facing edge of the portion 18*a*. The assembly 10 also includes an elongated weather cover panel 22, preferably constructed of a suitable aluminum alloy, which is attached to the base 16 so as to overlie an exterior edge portion of the interior side portion 18*a* and all of the exterior side portion 18*b* to thus form a foot tread. An elongated, compressible, resilient vinyl gasket 24 is connected along an interior facing edge portion of the panel 22 and extends along a narrow gap between the panel 22 and exterior facing side of the threshold member 14 to inhibit seepage of water through the gap. A series of conventional, adjustable fasteners 26 connect the threshold 14 to the interior side base portion 18*a* to permit the threshold member 14 to be adjusted so that it's upper surface conforms to the lower edge of the door 13** in relatively close fitting relationship when the latter is in a closed position in the frame as illustrated in an exaggerated manner in FIG. 4.

Figure 2:
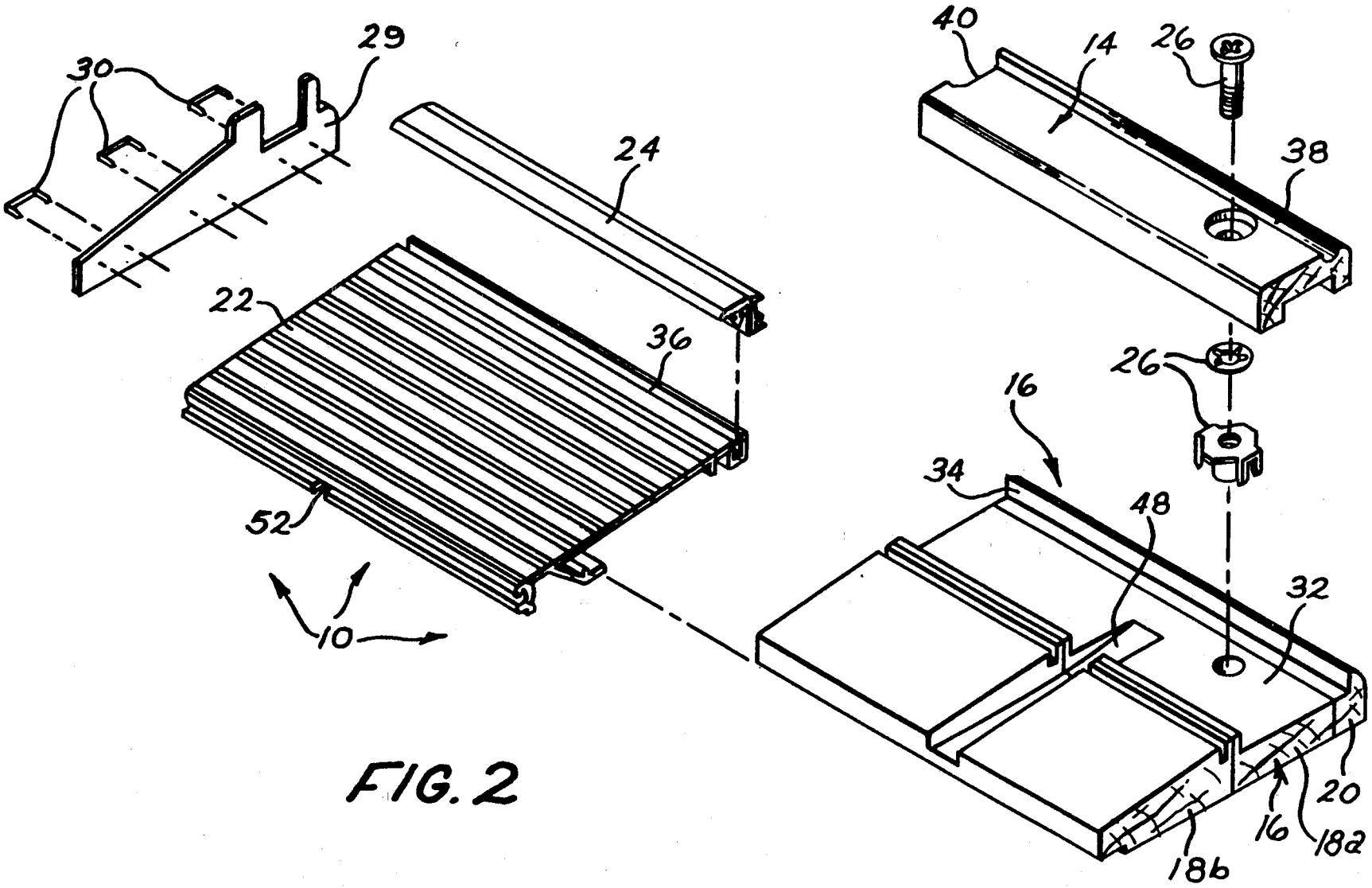
FIG. 2 shows an exploded perspective view of one end portion of the door sill assembly of FIG. 1.

The threshold 14 is of inverted U-shaped construction as viewed in cross-section in FIG. 3 so as to form an elongated, open chamber between the threshold 14 and interior side base portion 18*a*. A pair of compressible, resilient, waterproof end seal gaskets 29 (FIGS. 1-2), preferably constructed of a suitable closed cell polymer such as that sold under the trademark NEOPRENE, are suitably attached to opposite ends of the base 16 as, for example, by means of staples 30 (FIG. 2) for closing off lower opposing end portions of the water chamber formed between the threshold member 14 and base portion 18*a* when placed in compression between the jambs 12.

The threshold member 14 is thus supported on a floor 32 or upper surface of the interior base portion 18*a* between an exteriorally facing wall 34 of the shoe strip 20 and the gasket 24 and defines an elongated storm drain channel 38 in an upper, interior edge portion thereof. The storm drain 38 extends between and communicates with a pair of slots 40 located on opposite ends of the member 14, which slots 40, in turn, communicate with the underlying water chamber.

As is conventional, an underside of the door 13 contains a compressible, resilient, vinyl weatherstrip 44 which overlies the threshold member 14 in close fitting and rubbing relationship when the door 13 is in a closed position in the frame such that a series of elongated, spaced apart ribs 46 of the weatherstrip 44 engage and compress against an upper surface of the threshold member 14 along the exterior facing side of the storm drain 38. In the event the door 13 is slightly tilted in the frame, or is not perfectly rectangular, or in the event the base of the door frame is quite at right angles with the jambs 12, the fasteners 26 may be individually adjusted until the upper surface of the member 14 closely conforms to the weatherstrip 44 along essentially it's entire length. This arrangement, when properly adjusted, together with other conventional forms of weatherstripping which may be located along the jambs 12 form a conventional primary seal of the door frame plane against the encroachment of rain water which might otherwise blow or seep into the building when the door 13 is closed.

However, should such a conventional primary seal prove insufficient or in the event the weatherstrip 44 is damaged or otherwise does not conform sufficiently tightly against the threshold member 14 such that blowing rain water seeps past the primary seal onto the upper surface of the threshold member 14, the storm drain 38 provides a secondary means of protection. Under such circumstances, water flowing into the storm drain 38 migrates toward outer ends thereof, thence seeps downward through the slots 40 onto the floor 32 of the interior base portion 18*a* and thereafter migrates inwardly along the floor 32 in the water chamber to spill over into a pair of exteriorally extending weep channels 48 formed in the base portions 18*a* and 18*b*. The channels 48 extend downwardly either diagonally or, preferably, in an arc shaped path as shown, to thus carry water from the floor 32 exteriorally across the base portion 18*b* as indicated in FIG. 3 by arrows 49. Slots 50 and 52 are formed in downwardly extending portions of the weather cover 22 in alignment with the weep channels 48 so that water flowing in the channels 48 will be expelled out of the assembly 10.

Preferably, the base of 16 is constructed of wood. Since the shoe strip 20 is located along the interior side of the door 13 when closed and thus is always visible from within the building, I prefer to construct the shoe strip 20 of a suitable stain grade wood such as oak or the like. However, since the base 16 is concealed from view by the weather cover 22, gasket 24 and the threshold member 14 (and also by the door 13, when closed), the portions 18*a* and 18*b* forming the base 16 can be constructed of any suitable non-stain grade wood such as, for example, poplar. The visible threshold member 14 should also be formed of a suitable stain grade wood such as oak or the like.

It should also be noted that any water seepage occurring along and around the bore holes of the fasteners 26 and any seepage which may occur through or around the gasket 24 (as may occur with aging or damage) will likewise find its way to the floor 32 from whence it will be expelled from the assembly 10 through the weep channels 48 and weather cover slots 50 and 52. The base portions 18*a* and 18*b* may be connected by means of a suitable wood glue. The shoe strip 20 may also be affixed to the interior facing edge of the base 16 in the same manner.

Thus the subject invention includes the novel combination of (1) an adjustable threshold 14 for closely conforming along the length thereof to weatherstripping 44 extending along the underside of a door 42 when closed, and a storm drain channel 38 formed along an upper surface portion of the threshold 14 to gather water, which seeps or blows past the primary barrier represented by the weatherstripping 44, for expulsion from the assembly 10.

Although the present invention has been shown and described with respect to specific details of a certain preferred embodiment thereof, it is not intended that such details limit the scope and coverage of this patent other than as specifically set forth in the following claims.

I claim:

1. A self draining, adjustable door sill assembly comprising:

an elongate base adapted for disposition along a lower side of an exterior door frame between a pair of door jambs;

an elongate threshold member disposed over and adjustably connected to said base for cooperating, in a close fitting relationship, with a lower edge of a door when said door is in a closed position in said frame, said member and base defining an elongate water chamber therebetween, said member also defining an upwardly opening storm drain channel in an upper, interior facing side surface portion thereof, opposite ends of said drain channel terminating in and communicating with a pair of slots located on opposite ends of said member, said slots also communicating with opposite ends of said water chamber;

a weather cover panel connected to and overlying an exterior side portion of said base; and means defined by said base for draining water from said water chamber exteriorally beyond said door frame and assembly.

2. The assembly of claim 1 further comprising a pair of compressible, resilient, water proof gaskets attached to opposite ends of said base for closing lower end portions of said water chamber in a liquid tight manner when said base is disposed in a door frame such that said gaskets are placed in compression between said base ends and opposing jambs of said door frame.

3. The assembly of claim 1 wherein said base comprises;

an interior side portion, an exterior side portion attached to said interior side portion, and a shoe strip attached to and extending along an interior facing side of said interior side portion, said shoe strip extending upwardly above a floor of said interior portion to form an exteriorly facing wall, said threshold member being disposed on said floor against said wall.

4. The assembly of claim 3 wherein said shoe strip is constructed of a stain grade wood.

5. The assembly of claim 3 wherein said interior and exterior side portions are attached by means of wood glue.

6. The assembly of claim 3 wherein said shoe strip is connected to said interior side portion by means of wood glue.

7. The assembly of claim 3 wherein said interior and exterior side portions of said base are constructed of a non stain grade wood.

8. The assembly of claim 7 wherein said non stain grade wood is poplar.

9. The assembly of claim 1 wherein said base is constructed of wood.

10. The assembly of claim 1 further comprising an elongate gasket constructed of compressible resilient, water proof material attached to said panel and disposed between said panel and an exteriorally facing side of said threshold member exterior of a door when said door is in a closed position in a door frame containing said base, for inhibiting seepage of water downwardly between said panel and said member onto an upper surface of said base.

11. The assembly of claim 1 wherein said draining means comprises, at least one upwardly opening channel formed in an upper surface portion of said base and extending downwardly from a floor of said water chamber exteriorally under said panel to and through an outer side of said base.

12. The assembly of claim 11 wherein said draining means comprises two of said channels extending parallel to one another and being disposed on opposite end portion of said base inwardly of said slots.

13. The assembly of claim 11 wherein said weather cover contains a series of apertures through downwardly extending exterior side portions therein aligned with said draining means channels such that water flowing exteriorally from said channels is directed through said apertures exteriorally beyond said assembly.

14. The assembly of claim 11 wherein said draining means channel forms an arc shaped water run way.

15. The assembly of claim 1 wherein said draining means comprises a pair of spaced apart, upwardly opening channels formed in an upper surface portion of said base and extending downwardly from a floor of said water chamber exteriorly under said panel to and through an outer side of said base.

16. The assembly of claim 1 wherein said threshold member is constructed of a stain grade wood.

17. The assembly of claim 1 wherein said threshold member is constructed of oak.

18. The assembly of claim 1 wherein said weather cover panel is constructed of an aluminum alloy.

19. The assembly of claim 1 wherein said threshold member is of inverted U-shaped cross-section as viewed along its longitudinal dimension.

* * * * *